US005319871A

United States Patent [19]

Racheli

[11] Patent Number: 5,319,871

[45] Date of Patent: Jun. 14, 1994

[54] MAGAZINE FOR PORTABLE FIREARMS

[75] Inventor: Edoardo Racheli, Gardone V.T., Italy

[73] Assignee: MEC-GAR S.r.l., Brescia, Italy

[21] Appl. No.: 959,666

[22] Filed: Oct. 13, 1992

[30] Foreign Application Priority Data

Jul. 17, 1992 [IT] Italy ..... BS/92 A 000088

[51] Int. Cl.[5] ..... F41A 9/70

[52] U.S. Cl. ..... 42/50

[58] Field of Search ..... 42/7, 18, 22, 50; 89/195, 196, 197

[56] References Cited

U.S. PATENT DOCUMENTS

| | | | |
|---|---|---|---|
| 403,765 | 5/1889 | Mauser | 42/50 |
| 475,061 | 5/1892 | Krnka | 42/18 |
| 1,277,379 | 9/1918 | Chadwick et al. | 89/195 |
| 1,352,413 | 9/1920 | Payne | 42/50 |

*Primary Examiner*—Stephen C. Bentley
*Attorney, Agent, or Firm*—McGlew and Tuttle

[57] ABSTRACT

This invention refers to a magazine for firearms, including a chamber (11) with two lips (14) that are elasticized by at least one slit (15) in each side wall of the chamber to enable the insertion of each round of ammunition through a temporary divarication of the lips, obtained by resting the ammunition on them and exercising a pressure in the same direction to counteract the thrust of the spring on the elevating mechanism.

9 Claims, 2 Drawing Sheets

MAGAZINE FOR PORTABLE FIREARMS

FIELD OF THE INVENTION

This invention covers an improved magazine for portable firearms with a pull-out magazine.

BACKGROUND OF THE INVENTION

Magazines for portable firearms are generally made up of an ammunition chamber, an elevating mechanism which supports the ammunition in the chamber, and a spring that generally pushes upwards the elevating mechanism and the ammunition for chambering when the firearm is operated.

The top part of the chamber usually has two rigid facing lips that are slightly bent inwards to intercept and hold the ammunition in the chamber at one end and in opposition to the thrust of the spring on the elevating mechanism, while allowing it to be sent to the cartridge chamber of the gun.

In conventional magazines it is quite difficult to load ammunition into the chamber if done by hand, as generally occurs, or without the aid of specially designed devices. Loading takes place in two stages and with combined movements.

First it is necessary to position the ammunition and exercise with it a pressure on the front part not engaged by the chamber lips, at the top of the column of cartridges already loaded, so as to find enough space to house the new ammunition below the lips.

Then, while maintaining sufficient pressure to counteract the thrust of the spring on the elevating mechanism, the ammunition must be pushed in lengthwise on top of the one below until it comes up against the back wall of the chamber and positioned underneath the lips.

SUMMARY AND OBJECTS OF THE INVENTION

The aim of this invention is to offset this difficulty and simplify the insertion of ammunition in a firearm magazine.

The main aim of this invention is to provide a magazine that facilitates loading and enables ammunition to be inserted in the chamber simply by pressing it in the same direction and in the opposite direction to the thrust of the spring on the elevating mechanism in the magazine, i.e. with a quick and easy movement that can also be performed by hand.

This aim is attained substantially by elasticizing the lips at the top of the chamber that are used for holding the ammunition in the magazine. The lips are elasticized by means of a suitably sized and orientated slit in the top of the chamber for each lip, between it and the back wall of the chamber.

This means it is sufficient to rest the ammunition on the lip and apply sufficient downwards pressure on it to divaricate the lips and allow the ammunition to pass between them.

The lips automatically center the ammunition and when it has passed through, they close elastically and convey it downwards into the proper position on the elevating mechanism or on other rounds that have already been inserted.

BRIEF DESCRIPTION OF THE DRAWINGS

Further details on this invention are described below with reference to the drawings attached.

DETAILED DESCRIPTION OF THE PREFERRED EMBODIMENT

Figure 1:
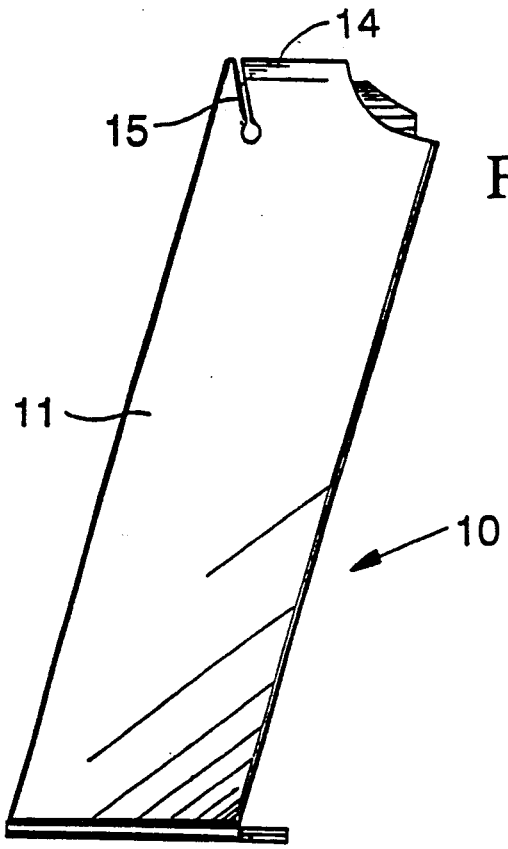
FIG. 1 shows an external view of the magazine.
Figure 2:
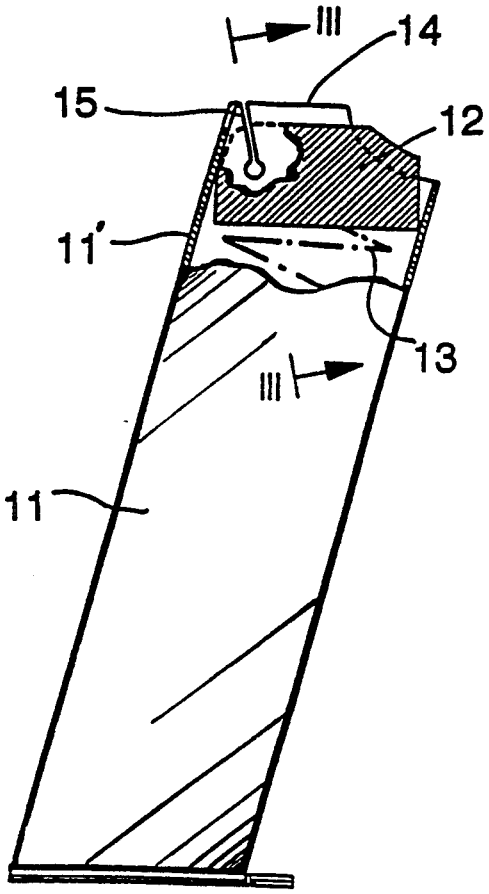
FIG. 2 shows a partial side view of the magazine in FIG. 1.
Figure 3:
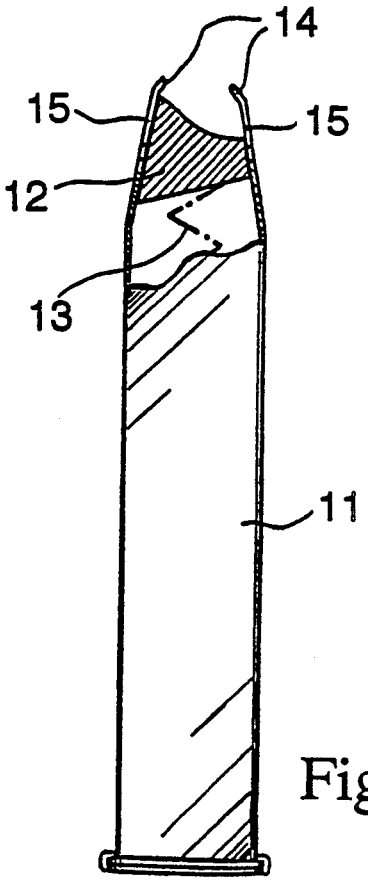
FIG. 3 shows a partial view according to arrows III—III in FIG. 2.
Figure 4:
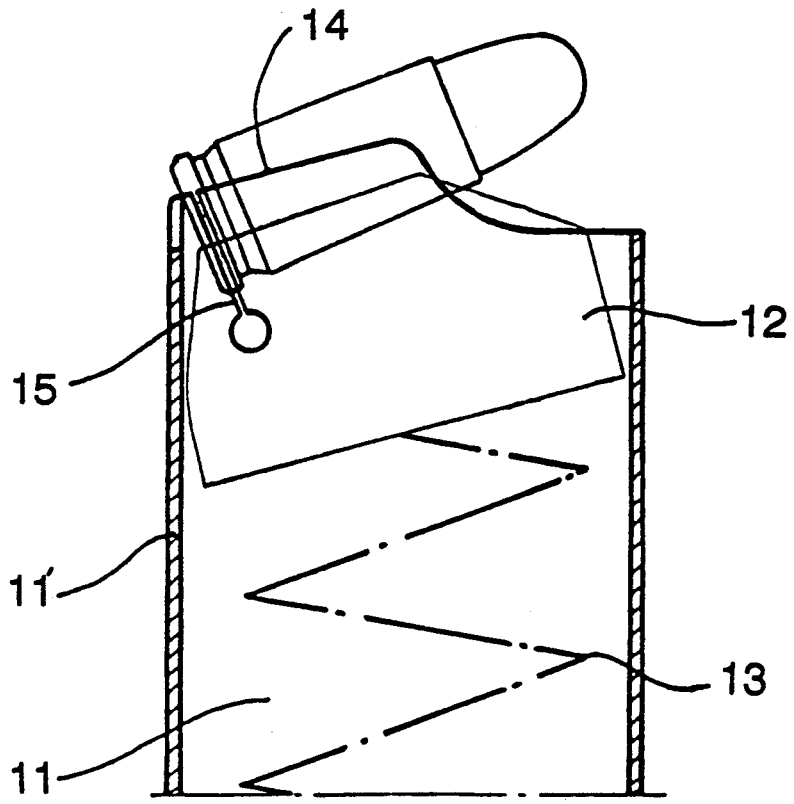
FIG. 4 is a cross sectional view showing the top of the magazine with an inserted cartridge.

In these drawings, the magazine assembly is represented by number 10 and is made up of a chamber (11), an elevating mechanism (12) in said chamber, and a spring (13) that pushes the elevating mechanism upwards from the bottom of the chamber.

The two sides of the chamber are larger than the front side and the back (11').

At the top of the chamber, each side wall ends in a lip (14) which generally occupies only one part of the same wall adjacent to the back wall. The lips (14) on the sides are slightly bent towards the inside of the chamber so as to intercept and hold the ammunition inserted.

In this invention, in each side of the chamber on a level with each lip (14), between it and the back wall (11'), there is a slit (15) to elasticize the lip and enable it to bend outwards and then return to its original position.

The dimensions, positions and orientation of the elasticizing slit (15) for each lip of the magazine are of basic importance. Details are set out below.

Width of the slit: it must be less than the width of the collar of the ammunition cartridge case in order to prevent the ammunition from being held back as it is conveyed towards the barrel.

Length of the slit: this factor determines the elasticity of the lip and its opening resistance during insertion of the ammunition; the length is usually equal to the height of the lip above the side wall of the chamber.

Position of the slit: the slit must be made as close as possible to the corner of the chamber between the side wall and the back wall (11'), i.e. half way along the cartridge case collar. This is to prevent the elastic lips from engaging the cartridge case collar and holding back the ammunition during chambering, i.e. when the ammunition is removed from the magazine by the breech block as it moves towards the closed position.

Orientation: the slit is oblique and extends towards the centre of the side wall starting from the top edge between the lip and the back wall of the chamber.

The slit must be a careful compromise between the resistance of the lip and the resistance of the back wall of the magazine which the bottom of the ammunition rests against.

The improvement as described herein can be applied to one- and two-row magazines on any type of portable firearms.

In practice, the two elasticized lips (14) act as bottom-anchored shelves which, being free and pushed upwards by the pressure on the ammunition inserted in the chamber, can bend outwards and open enough to allow the ammunition to pass through.

Considering that the chamber is usually made of carbon nitrided material, the amount of stress exerted on the flexible lips only involves elastic deformation, since the unit load is always well below the yield point.

I claim:

1. A magazine for firearms, comprising:

chamber means defining a chamber with two side walls, a front wall and a back wall, said back wall extending to a height above said front wall;

a lip formed at a top edge of said of said side walls defining an extension of said side walls, each said lip being bent slightly inwardly to intercept and hold ammunition inserted into said chamber means;

elevating means positioned within said chamber means for supporting ammunition in said chamber;

spring means positioned in said chamber means for pushing said elevating means and ammunition upwards from a bottom of said chamber;

elasticizing means including a slit at a side of each lip extending from adjacent said rear side wall downwardly through the side wall, said slit having a slit length substantially equal to a difference in height between said rear wall and said front wall such that each lip flexes and is connected to a corresponding side wall at a lower portion of said lip for insertion of each round of ammunition by temporarily flexing each lip with respect to an associated side wall by resting ammunition on said lips and pushing ammunition towards said spring to counteract a thrust of said spring.

2. A magazine according to claim 1, wherein said slit adjacent a lip extends to a height of said rear wall of said chamber means.

3. A magazine according to either claim 1 or claim 2, wherein each said lip has a width which is smaller than a width of a collar of ammunition to be inserted in said chamber.

4. A magazine according to claim 2, wherein said slit is positioned to be aligned with a collar of a cartridge case inserted into said chamber means, whereby said slit extends half way between sides of said collar.

5. A magazine according to claim 2, wherein each said slit is positioned extending obliquely from a top edge adjacent to said rear wall toward a lower terminating end toward a center of said side wall.

6. A magazine for firearms, comprising:

chamber means defining a chamber with two side walls, a front wall and a back wall, said back wall extending to a height above said front wall;

a lip formed at a top edge of each of said side walls defining an extension of said side walls, each said lip being bent slightly inwardly to intercept and hold ammunition inserted into said chamber means;

elevating means positioned within said chamber means for supporting ammunition in said chamber;

spring means positioned in said chamber means for pushing said elevating means and ammunition upwards from a bottom of said chamber;

elasticizing means including a slit at a side of each lip extending from adjacent said rear side wall downwardly through the side wall, said slit having a slit length substantially equal to a difference in height between said rear wall and said front wall such that each lip flexes and is connected to a corresponding side wall at a lower portion of said lip for insertion of each round of ammunition by temporarily flexing each lip with respect to an associated side wall by resting ammunition on said lips and pushing ammunition towards said spring to counteract a thrust of said spring;

said slit extending from a location directly adjacent to a corner of said chamber means, corresponding to an intersection of each side wall with said back wall.

7. A magazine according to claim 6, wherein each said slit has a width which is less than a width of a collar of an ammunition cartridge positionable in said chamber means for preventing ammunition from being retained in said slit as ammunition is conveyed towards a barrel of the firearm.

8. A magazine according to claim 6, wherein said location of said slit corresponds to a location of said cartridge case collar as a cartridge case is moved within said chamber means past said slit, wherein said slit is located halfway between ends of said cartridge case collar.

9. A magazine according to claim 6, wherein said slit extends from said upper portion obliquely to a terminating end toward a center of said side wall.

* * * * *